US009308532B2

(12) United States Patent
Fried

(10) Patent No.: US 9,308,532 B2
(45) Date of Patent: Apr. 12, 2016

(54) GYRATORY CRUSHER DEVICE

(71) Applicant: FLSmidth A/S, Valby (DK)

(72) Inventor: Andrew Charles Fried, Slatington, PA (US)

(73) Assignee: FLSMIDTH A/S (DK)

( * ) Notice: Subject to any disclaimer, the term of this patent is extended or adjusted under 35 U.S.C. 154(b) by 0 days.

(21) Appl. No.: 14/432,508

(22) PCT Filed: Oct. 2, 2013

(86) PCT No.: PCT/DK2013/050312

§ 371 (c)(1),
(2) Date: Mar. 31, 2015

(87) PCT Pub. No.: WO2014/053143

PCT Pub. Date: Apr. 10, 2014

(65) Prior Publication Data

US 2015/0273473 A1 Oct. 1, 2015

(30) Foreign Application Priority Data

Oct. 2, 2012 (DK) ..... 2012 70600

(51) Int. Cl.
*B02C 2/06* (2006.01)
*B02C 2/04* (2006.01)

(52) U.S. Cl.
CPC .. *B02C 2/047* (2013.01); *B02C 2/06* (2013.01)

(58) Field of Classification Search
CPC ..... B02C 2/06; B02C 2/04; B02C 2/047
USPC ..... 241/207–216
See application file for complete search history.

(56) References Cited

U.S. PATENT DOCUMENTS

| | | | | |
|---|---|---|---|---|
| 2,066,281 | A * | 12/1936 | Traylor, Jr. | B02C 2/06 241/211 |
| 2,699,900 | A * | 1/1955 | Traylor, Jr. | B02C 2/045 241/209 |
| 4,568,031 | A * | 2/1986 | Mitrofanov | B02C 2/042 241/210 |
| 4,844,362 | A | 7/1989 | Revnivtsev | |
| 6,772,970 | B2 | 8/2004 | Davis et al. | |
| 2009/0008489 | A1 | 1/2009 | Nieminen | |
| 2010/0155518 | A1 | 6/2010 | Eriksson | |

FOREIGN PATENT DOCUMENTS

FR 1569863 6/1969

OTHER PUBLICATIONS

International Search Report and Written Opinion dated Jan. 15, 2014, 9 pages.

* cited by examiner

*Primary Examiner* — Mark Rosenbaum
(74) *Attorney, Agent, or Firm* — Jeffrey A. Sharp; Matthew R. Weaver; Aaron M. Pile

(57) ABSTRACT

A crusher device includes a crusher head positioned within a container that is fed material to be crushed by the crusher head. The body of the crusher head includes at least one aperture in which at least one of an eccentric assembly and a portion of a cylinder is positioned. The container that receives material may be defined by a substantially vertical inner wall. The inner wall may be defined by a wearable surface. The crusher head may also have a wearable surface defined by a mantle.

13 Claims, 3 Drawing Sheets

GYRATORY CRUSHER DEVICE

CROSS-REFERENCE TO RELATED APPLICATIONS

This application claims the benefit of Danish priority application number PA 2012 70600 filed 2 Oct. 2012.

FIELD OF INVENTION

The present invention relates to crusher devices. For example, an embodiment of the present invention may be considered to be a type of gyratory crusher or a modified gyratory crusher.

BACKGROUND OF THE INVENTION

Gyratory crushers are often used to crush rock and other material extracted during mining operations to crush the material into smaller sizes for subsequent processing. Examples of gyratory crushers may be appreciated from U.S. Patent Application Publication Nos. 2011/0259984 and 2011/0155833 and U.S. Pat. Nos. 8,033,491, 3,666,188 and 2,667,309.

As mining equipment and milling equipment sizes have increased, the demand for crushing capacity for extracted material has increased. Consequently, there has been a growing need for larger crushers to provide higher rates of crushed material to output for subsequent processing and extraction of desired minerals or ore from the crushed material. Some crusher circuits are now being designed or updated to use more gyratory crushers to accommodate this desire for an increased rate of crusher production.

But, the use of more gyratory crushers incurs a substantial cost. For example, the cost of such equipment is typically large as such devices are often configured to crush thousands of tons of material per hour and tens of thousands of material per day. Sizes of gyratory crushers often range from ten feet to thirty-five feet in height and ten to twenty-one feet in width. Such large equipment results in extensive capital costs. Additionally, the maintenance of such large equipment can incur substantial costs. Simply using more of the same equipment to meet a demand for ever increasing amounts of material therefore can incur substantial operational expenses in addition to the capital expenses associated with such devices.

I have determined that a new crusher is needed that can provide an increased rate of production for a comparably sized conventional crusher. I have determined that such a crusher preferably permits maintenance to occur more easily so that less downtime is associated with the maintenance of the device.

SUMMARY OF THE INVENTION

A gyratory crusher is provided that includes a container, a crusher head positioned within the container, and at least one of an eccentric and a piston of a cylinder at least partially positioned within at least one aperture of the crusher head. The container may be at least partially defined by an inner wall of the gyratory crusher. The crusher head may be located within the container so that rotational or eccentric movement of the crusher head moves causes material within the container to be crushed.

In one embodiment, the crusher head may have a body that has a first cavity or channel defined therein. The first cavity or first channel may be the at least one aperture of the crusher head. The body of the crusher head may be attached to the mantle which directly engages with material to crush the material. In some embodiments, the eccentric and the piston of the cylinder may be partially positioned within the first cavity or the first channel. The piston of the cylinder may include a piston member that is adjustable to a plurality of positions to adjust a vertical position of the crusher head within the container. For instance, the piston member may retract into or extend from a barrel of the cylinder to adjust a position of the piston member.

The eccentric may be positioned so that it surrounds at least a portion of the cylinder. For instance, a portion of the eccentric may surround a perimeter of a portion of a barrel of the cylinder. A bushing or other element may be located between the eccentric and the cylinder when the eccentric is positioned to surround a portion of the cylinder.

The inner wall that may at least partially define the container may extend upwardly so that the inner wall is substantially vertical or is perfectly vertical. For instance, the inner wall may extend upwardly to a top of the inner wall at an angle of 90° to 95° relative to a perfectly horizontal plane with the top of the inner wall being more outward relative to the bottom portion of the inner wall or at an angle of between 85° and 100° relative to a perfectly horizontal plane.

A bottom portion of the inner wall may be curved or bent away from the crusher head to define an outer side of a discharge opening through which crushed material passes. The discharge opening may be defined by a bottom portion of the crusher head and the bottom portion of the inner wall. The bottom portion of the crusher head may include a portion of a mantle connected to a body of the crusher head. It should be understood that if the bottom portion does bend away, this bent away portion of the inner wall may not be used to assess whether the inner wall extends upwardly so that it is substantially vertical or is perfectly vertical.

In some embodiments, the crusher head may include a unitary body that is cast as a body that is attached to a mantle. In other embodiments, the crusher head may include a body that has a central opening for receiving a main shaft and be attached to the main shaft after the main shaft is positioned in such an opening. The main shaft may be mechanically affixed or may be attached by other means such as use of an epoxy or other fastening means.

In one embodiment of the crusher, a bushing is positioned within the first channel that engages a portion of the eccentric. For instance, the bushing may be an outer radial bushing or an inner radial bushing. The crusher head may eccentrically rotate via the eccentric to crush material as well.

In one embodiment, the cylinder may be a hydraulic cylinder and the piston of the cylinder may at least partially support the crusher head for vertically moving the crusher head. The piston of the cylinder may be positioned within a first aperture of the body of the crusher head so that it is adjacent to a main shaft, the body of the crusher head, or both the main shaft and body of the crusher head.

In some embodiments of the crusher, the inner wall may be considered a first wall and the crusher may also include at least one second wall. The at least one second wall may be located so that the top of that at least one second wall is within the at least one aperture and the second wall extends from its top to below the crusher head. The at least one second wall is sized to receive and retain a portion of the cylinder, such as a portion of the piston of the cylinder. The at least one aperture of the crusher head may include a first aperture that is defined in a body of the crusher head that is attached to a mantle so that the mantle directly engages with material to crush the material. The eccentric and the piston of the cylinder may each be partially positioned within the first aperture of the body of the crusher head. The piston may include a piston member that is adjustable to a plurality of positions to adjust the position of the crusher head within the container. The piston member may be extendable and retractable from within the opening defined by the at least one second wall located at least partially within the crusher head. The piston member and crusher head may move vertically relative to the eccentric when the piston member is extended or retracted. An example of vertical movement may be a substantially vertical movement where the piston member moves vertically at an angle or may be a perfectly straight up or down movement. The eccentric may be maintained in its position via an attachment to the at least one second wall or a positioning on the at least one second wall such that the eccentric is only rotatable and is not vertically moveable, for example.

The crusher may include a spider. The spider may have a hub and first and second arms that extend from the hub. A cap may be positioned to cover the hub in some embodiments. The upper end of a main shaft or body of a crusher head may be moveably positioned adjacent to the hub of the spider. The first and second arms may extend to opposite sides of a frame of the crusher that supports the container, the crusher head and the main shaft.

Embodiments of the crusher may also include a drive mechanism. The drive mechanism may include a belt drive that rotates a shaft. The rotated shaft may be connected to one or more gears to drive rotation of the one or more gears. The one or more gears may be attached to the eccentric so that rotation of the gears drives rotation of the eccentric, which is attached to the crusher head so that the rotation of the eccentric drives rotation of the crusher head.

Embodiments of the crusher may also include a controller that is communicatively connected to the drive mechanism to actuate adjustment of a speed at which the crusher head rotates. The controller may also be communicatively connected to the cylinder to actuate movement of the piston member of the cylinder to adjust a vertical position of the crusher head within the container.

Other details, objects, and advantages of the invention will become apparent as the following description of certain present preferred embodiments thereof and certain present preferred methods of practicing the same proceeds.

BRIEF DESCRIPTION OF THE DRAWINGS

A present preferred crusher device is shown in the accompanying drawings and certain present preferred methods of practicing the same are also illustrated therein. It should be understood that like reference numbers used in the drawings may identify like components. While one embodiment of the crusher device is illustrated in the drawings, it should be appreciated by those of at least ordinary skill in the art that multiple different embodiments of the crusher device may be utilized as may be better appreciated from the above and below.

DETAILED DESCRIPTION OF EXEMPLARY EMBODIMENTS

Figure 1:
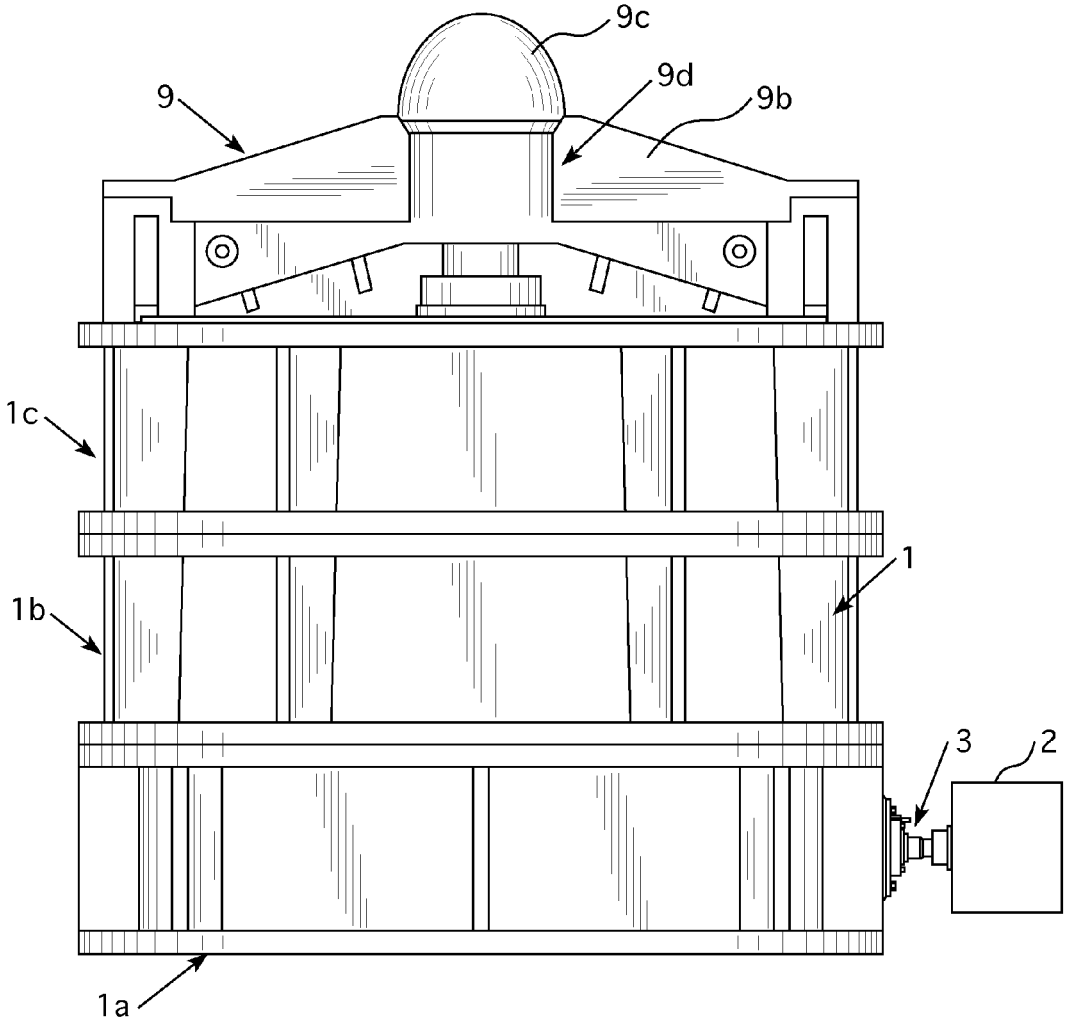
FIG. 1 is a perspective view of an exemplary embodiment of the crusher device.
Figure 2:
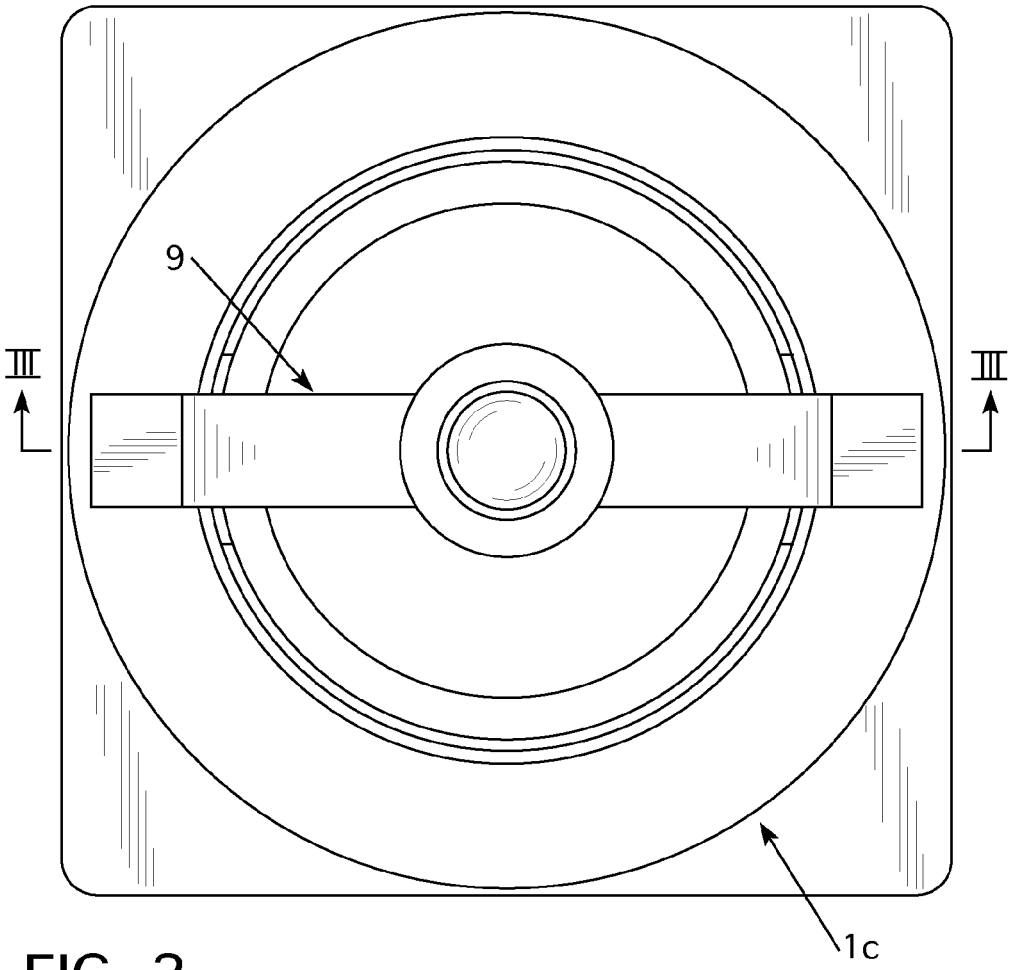
FIG. 2 is a top view of the exemplary embodiment of the crusher device.
Figure 3:
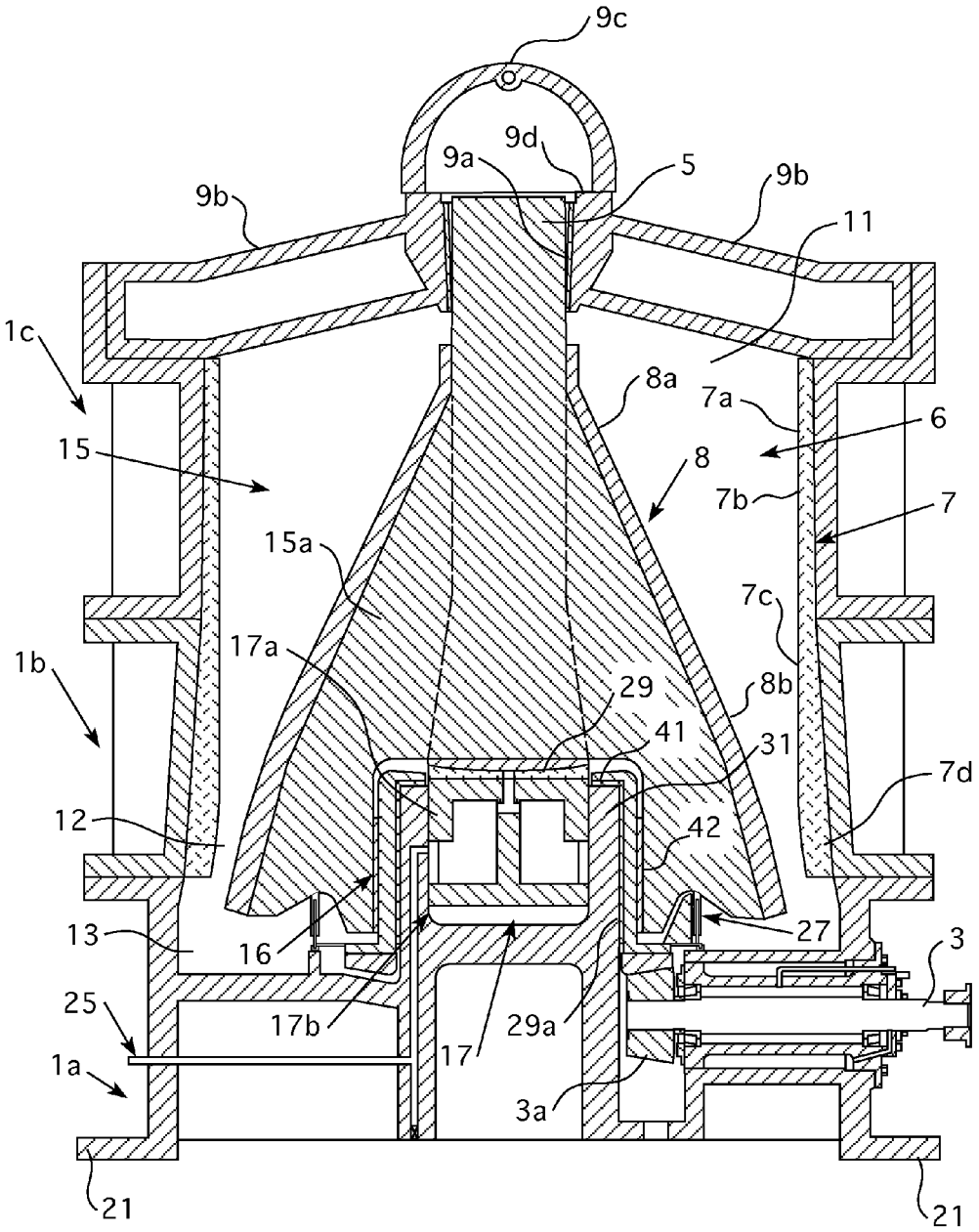
FIG. 3 is a cross sectional view taken along line III-III in FIG. 2 of the exemplary embodiment of the crusher device.

Referring to FIGS. 1-2, a crusher device 1 has an outer frame that is composed of metal such as steel. The crusher device 1 may be considered to be a gyratory crusher. The metal is preferably durable and configured so that the crusher device 1 may be positioned for receiving large pieces of material obtained during a mining operation or is positioned for receiving material for sizing the material to a desired size range. For example, some embodiments of the device may merely be used to provide sizing of material to a desired size range. Other embodiments of the device may be used to reduce the size of material fed to the device to make subsequent transport and processing of the crushed material manageable for other processing mechanisms used to extract a desired mineral or ore from the crushed material.

The material that may be crushed by the crusher device 1 could be any of a number of possible materials. For instance, the material may be rock, aggregate, material containing alumina or bauxite, material containing basalt, material containing copper ore, material containing dolomite, material containing gold, material containing granite, material containing gypsum, material containing iron ore, limestone, material containing molybdenum, material containing nickel ore, material containing silver ore, or trap rock.

The crusher device 1 may include a frame that has a base 1*a*, an intermediate section 1*b* and a top section 1*c*. The material may be fed through an opening 11 defined in the top section 1*c*. In one embodiment, the feed opening 11 may be 1700 mm. Of course, other embodiments may be sized to increase or decrease the feed opening 11 as desired to meet a particular design objective.

The intermediate section 1*b* and top section 1*c* of the frame of the crusher device may be configured to support an inner wall 7 that defines a container or receptacle in which the material is crushed. In some embodiments, the base 1*a* of the frame may also be configured to support the container or receptacle in which the material is crushed. A crusher head 15 may also be positioned in the container. The container may be 4500 mm wide in one embodiment. Of course, the container could be wider or narrower in width in other embodiments to meet a particular design objective.

The base 1*a* of the crusher device is configured to support the weight of the crusher device. The intermediate section 1*b* or the base 1*a* may have at least one opening or outlet in which crushed material is output during crushing operations. The crushed material that is output via the one or more outlets may be loaded onto trucks for transport by one or more cranes, front loaders, excavators or other loading device, loaded onto a conveyor system for transport by such devices, or may be directly deposited via the outputting of the crushed material onto a conveyor system or other mechanism for transport to another device or facility for subsequent processing.

The top section 1*c* of the crusher device is attached to a spider 9 that extends from a first side of the crusher device toward a second side of the crusher device that is opposite the first side. The spider 9 may include only one arm or may include a plurality of arms such as two arms, three arms, or four arms. In one embodiment, the spider 9 includes a central hub 9*d* that is covered by a cap 9*c* and multiple arms 9*b* that extend from the hub to opposite sides of the crusher device. Each arm 9*b* may be attached to the top section 1*c* of the frame of the crusher device 1. Each arm may be attached to the top section 1*c* of the frame via a fastening mechanism such as one or more bolts, one or more fasteners, one or more interlocking mechanisms, one or more fastening devices, or a combination of such attachment mechanisms.

The spider 9 also includes a spider bushing 9*a* that is configured to engage an end of a main shaft 5 that extends from the spider 9 to adjacent the base 1*a* of the crusher device 1. The spider bushing 9*a* may be attached to the hub of the spider 9 and may permit the main shaft to slide, rotate, and gyrate along the bushing 9*a* so that the upper end of the main shaft is vertically movable adjacent the hub of the spider. The spider bushing 9*a* may be positioned adjacent the upper end of the main shaft 5 so that the main shaft 5 is able to rotate or gyrate adjacent the arms 9*b* of the spider 9.

The main shaft 5 may be a solid cylindrical member or a partially hollow cylindrical member that is tapered outwardly at its bottom end so that the bottom end is wider than the upper end of the main shaft or is tapered at its bottom end so that the bottom end is narrower than the upper end of the main shaft. In yet other embodiments, the main shaft 5 may have an upper end that is the same width as the bottom end. The main shaft 5 may be composed of steel or other metal material and may be a generally cylindrical structure.

The main shaft 5 may be attached to a body 15*a* of a crusher head 15. For instance, the body 15*a* of the crusher head 15 may be configured to have at least one continuous channel formed therein to permit an epoxy or other filler to be fed therein for facilitating the attachment of the main shaft 5 to a body 15*a* of a crusher head 15. Fasteners, a fastening mechanism, or other fastening means may also be used to attach the main shaft 5 to the body 15*a* of the crusher head 15.

In some embodiments, it is contemplated that the main shaft 5 may be integrally formed with the body 15*a* of the crusher head 15. For example, the body 15*a* may be cast so that the main shaft 5 is an integral component of the body 15*a*. For instance, it is contemplated that the main shaft 5 may be a portion of a cast member having a conical shaped structure, a generally conical shaped structure, a generally frustum shaped structure, or a truncated cone shaped structure. It is contemplated that the body 15*a* of the crusher head 15 may be hollow or include at least one cavity or chamber formed therein. In such embodiments of the crusher head 15, a central portion of this structure that includes an upper end moveably attached to the spider 9 may be the main shaft and the outer portion of the structure located between an exterior mantle 8 and the main shaft section may be considered the body 15*a* of the crusher head 15.

The main shaft 5 may be located in a middle section of the crusher device 1. In one embodiment, the main shaft 5 may be located in a central section of the crusher device and may extend from the top section 1*c* to adjacent the base 1*a* of the crusher device 1. The main shaft 5 may be attached to a crusher head 15 so that the main shaft is moveable via movement of the body 15*a* of the crusher head. The body 15*a* of the crusher head may be rotated to eccentrically gyrate the body 15*a* of the crusher head via a connection the body 15*a* has with an eccentric 16 that is connected between the body 15*a* and a countershaft 3. The countershaft 3 is rotated by a drive mechanism 2 to drive the eccentric gyration of the body 15*a* of the crusher head 15.

The drive mechanism 2 may include a moveable belt drive system or other drive mechanism that is actuated to rotate the countershaft 3. The rotated countershaft 3 may cause rotation or other movement of the eccentric 16 via one or more intermeshed gears 3*a* that connect the eccentric 16 to the counter shaft 3. The eccentric 16 may be used to interconnect the countershaft 3 to the body 15*a* of the crusher head 15 to drive movement of the body 15*a*. The eccentric 16 is positioned at least partially within the body 15*a* of the crusher head 15 and is configured to engage with a gear 3*a* connected to the countershaft 3 for driving rotational movement of the body 15*a* of the crusher head 15 so that the body 15*a* rotates in an eccentric path so that the crusher head 15 gyrates eccentrically as it rotates. Such a path of rotation may be a generally circular eccentric path or an elliptical eccentric path, for example.

The eccentric 16 may be fully positioned within a channel or cavity defined within the bottom end portion of the body 15*a* of the crusher head 15 or may be partially positioned within such a channel or cavity. For instance, an eccentric may be partially positioned within the cavity defined in the body 15*a* of the crusher head adjacent to the main shaft 5 or may be fully positioned within the cavity defined in the body 15*a* of the crusher head adjacent to the main shaft 5. In one embodiment, the eccentric 16 may be positioned within the channel or cavity defined within the body 15*a* of the crusher head 15 and be positioned below the main shaft 5.

A first bushing 29 such as a thrust bushing or other type of bushing may be positioned within the body 15*a* of the crusher head 15 and below the main shaft 5 to help position the body 15*a* of the crusher head 15 within the container of the crusher device. In some embodiments, the first bushing 29 may include multiple bushings or be an assembly of multiple bushings located between the body 15*a* of the crusher head 15 and a piston member 17*a* of a cylinder 17.

Additionally, a second bushing 29*a* such as radial load bushing or other type of bushing may be positioned at least partially within the channel of the body 15*a* of the crusher head 15 adjacent the eccentric 16. The second bushing 29*a* may be positioned to engage a portion of the base 1*a* of the frame or one or more walls 31 that extend upwardly and are attached to the base 1*a* of the frame that may extend into or near the channel defined by the body 15*a* of the crusher head 15. For example, the second bushing 29*a* may be attached to a vertical wall 31 that extends upwardly and has an upper section positioned within the channel or cavity defined by the body 15*a* of the crusher head 15. The wall 31 may be attached to the base 1*a* of the frame of the crusher device such that the wall 31 extends from within the cavity defined in the body 15*a* of the crusher head 15 to a position located below the bottom of the body 15*a* of the crusher head 15. It should be understood that the second bushing 29*a* may be positioned adjacent the eccentric 16 for supporting the eccentric and gear weight loads.

In some embodiments, an upper part 41 of the second bushing 29*a* may be integral with the eccentric 16 or be a separate element that is positioned adjacent the top of wall 31 to engage the eccentric 16 to support the eccentric 16 upwardly to hold the weight of the eccentric 16 and maintain the general position of the eccentric 16. If the upper part 41 is a separate element, it may be a bushing, bearing, a bushing assembly or a bearing assembly.

A third bushing 42 such as an outer radial bushing may be positioned within the channel or cavity defined by the body 15*a* of the crusher head 15. The outer radial bushing may be attached to the body 15*a* and be positioned between the eccentric 16 and body 15*a* to engage the eccentric 16. In alternative embodiments, the third bushing 42 may be attached to the eccentric 16.

The eccentric 16 may be positioned so that a portion of a cylinder or other mechanical lifting mechanism is located at least partially within the body 15*a* of the crusher head 15 as well. A hydraulic cylinder 17 or other type of mechanical actuator may be positioned so that at least a portion of the cylinder is located within the channel or cavity formed in a bottom end portion of the body 15*a* of crusher head 15 for example.

A portion of the hydraulic cylinder 17 may be at least partially surrounded by the eccentric 16 as well. The eccentric 16 may be located directly around a periphery of the hydraulic cylinder 17 or along the periphery of a portion of the hydraulic cylinder 17 such as the barrel of the hydraulic cylinder or around a portion of a piston member 17*a* of the hydraulic cylinder 17. The eccentric 16 may directly engage that portion of the hydraulic cylinder or may be at least partially around a periphery of the hydraulic cylinder 17 or portion of the cylinder 17 such that one or more intervening structures are located between the eccentric and the hydraulic cylinder 17.

The hydraulic cylinder 17 may include a piston that extends from a barrel 17*b*. The piston of the cylinder may include a piston member 17*a* that extends from out of the barrel 17*b* to engage the first bushing 29 or other component of the crusher device to vertically adjust a position of the main shaft 5 and the crusher head 15. In one embodiment, the barrel 17*b* of the cylinder is defined by at least one wall 31 attached to the frame of the crusher device. The one or more walls 31 may define the barrel and retain hydraulic fluid used to adjust a position of the piston member 17*a*, which may extend out of or retract into the opening defined by the one or more walls 31 for defining the barrel of the cylinder 17.

The piston member 17*a* may engage the first bushing 29 or the body 15*a* of the crusher head 15 to adjust a vertical position of the crusher head 15. The piston member 17*a* may be extended to raise the main shaft 5 and raise the crusher head 15 to change the size of the discharge opening 12 through which crushed material may pass. Such a change in size of the discharge opening may be needed to permit an uncrushable element to be passed through the crusher device 1 when its presence is detected, for example. The piston member 17*a* may be retracted to lower the position of the main shaft and lower the crusher head 15 to change the size of the discharge opening 12 as well. The change in size of the discharge opening can adjust a size range of crushed material that passes through the discharge opening and also may increase or decrease a residence time for material to be located within the space 6 of the container defined by the inner wall 7 of the crusher device 1. The lifting and lowering of the crusher head 15 can also adjust an amount of wear experienced by the mantle 8 of the crusher head 15 and the inner wall 7 of the container defined by the inner wall as well as adjust the wear profile of the inner wall 7 for wear experienced by the inner wall 7 during crushing operations.

It should be understood that while the piston member 17*a* may be extended or retracted to adjust a vertical position of the crusher head 15, the eccentric 16 may be maintained in its same position. The eccentric 16 may not vertically move while the piston member 17*a* is moved and the crusher head 15 is moved. The eccentric may be vertically affixed in its positioned via its attachment to or positioning on the one or more walls 31 partially within the channel of the body 15*a* of the crusher head 15 so that the eccentric only rotates in movement and does not vertically move substantially upwards or downwards.

A conduit 13 may extend from adjacent the base portion 1*a* of the frame of the crusher device 1. Crushed material that is emitted through discharge opening 12 may pass through the conduit 13 to a location external to the crusher device frame. In one embodiment, the conduit 13 is merely a larger opening defined by the frame that is positioned below the discharge opening 12 and a portion of the crusher head 15.

The crusher head 15 attached to the main shaft is moveable within the space 6 of the container defined by the inner wall 7 of the crusher device 1 via movement of the piston member 17*a* of the cylinder 17 for vertical movement and moveable attachment to the eccentric 16 for eccentric gyratory movement and rotational movement. The crusher head 15 may include a metal body that has a central opening defined therein for receiving the main shaft 5 and being attached to the main shaft 5.

The crusher head 15 may also have a wear surface such as a mantle 8. The mantle 8 may be attached to a body 15*a* of the crusher head 15 that is attached to the main shaft 5. The mantle 8 may be attached to the body 15*a* so that movement of the body 15*a* of the crusher head 15 causes the mantle 8 to directly engage material for crushing the material within a crushing space 6 defined between the mantle 8 and an inner wall 7 that extends from adjacent to top section 1*c* to adjacent the base 1*a* of the crusher device. The crushing space 6 may be the opening within the container in which material is crushed defined by the intermediate section 1*b* and top section 1*c* of the crusher device 1.

The mantle 8 may be a wearable surface that has a desired thickness and shape for attachment to the exterior of the crusher head body 15*a*. The mantle 8 may include an upper mantle 8*a* and a lower mantle 8*b* that are attached together. Alternatively, the mantle 8 may be an integrally formed structure. The mantle may be composed of a hard metal and be configured to wear during crushing operations. The mantle 8 may be removed and replaced with a new mantle when the mantle has experienced sufficient wear to warrant replacement. A replacement mantle may be attached to the crusher head body 15*a* so that a whole new crusher head is not needed every time the mantle 8 needs replaced due to wear or damage.

The container in which the crusher head 15 is positioned and moves is defined by the inner wall 7 of the crusher device. The inner wall 7 may be a wearable surface that is attached to a frame of the crusher device. The inner wall may extend from adjacent the top section 1*c* of the crusher device to adjacent the base 1*a* of the crusher device. The inner wall 7 may extend substantially vertically or perfectly vertically to define a straight or substantially straight wall. The inner wall 7 may have an upper section 7*a* that is above a first intermediate section 7*b* of the inner wall. The first intermediate section 7*b* of the inner wall may be above a second intermediate section 7*c* of the inner wall. The bottom of the inner wall 7*d* may be below the second intermediate section 7*c* of the inner wall 7. The different sections of the inner wall 7 may be interconnected together or may be integrally formed to define the inner wall. Alternatively, the different segments may be attached to the frame and positioned so that immediately adjacent sections abut each other. For such embodiments, pins or other members may extend between adjacent segments as well.

The inner wall 7 may define a surface of the container in which material is positioned for crushing that extends substantially vertically from the bottom of the inner wall. For instance, the inner wall may extend vertically at an angle of 85° to 100° relative to a perfectly horizontal plane located at the end of the second intermediate section 7*c* or bottom 7*d* of the inner wall 7. Most preferably, the inner wall 7 would extend vertically at an angle of between 90° to 95° relative to a perfectly horizontal plane at the end of the second intermediate section 7*c* or bottom 7*d* of the inner wall 7 so that the top of the inner wall is located more outward that a lower section of the inner wall. It should be understood that the inner wall extending vertically at 90° relative to a perfectly horizontal plane may be considered to be an inner wall that extends perfectly vertical.

The inner wall 7 also extends horizontally around the crusher head 15 to define the container in which material is crushed by the crusher head 15. The inner wall 7 may extend horizontally along a curved path. For instance, the inner wall 7 may extend horizontally so that the inner wall is shaped so that the container defined by the inner wall is cylindrical in shape, tubular in shape, or generally cylindrical in shape.

The bottom end of the inner wall defining the container in which material is crushed via movement of the crusher head 15 may be configured so that it bends away from the crusher head 15 to help define an outer side of the discharge opening 12 or to provide a desired wear profile of the inner wall. The discharge opening 12 may also be defined along its inner side by the position of a bottom portion of the crusher head 15 and mantle 8. The second intermediate section 7*c* of the inner wall 7 may also be configured to bow outwardly relative to the upper intermediate second 7*b* to provide a desired wear profile for the inner wall 7.

For embodiments of the crusher device that utilize a bottom end portion 7*d* that bends away from the crusher head to provide a larger sized discharge end to facilitate the discharge of crushed material, it should be understood that when considering how the inner wall 7 vertically extends, the portion of the bottom portion 7*d* of the inner wall 7 that is bent away from the crusher head to help define the discharge opening should be ignored.

The inner wall 7 may be comprised of metal structures that are configured to define a wearable surface of the container of the crushing device 1. The inner wall 7 may then be replaced or repaired when a segment of the wall is damaged or is worn out and needs replaced. For instance, the inner wall 7 may be comprised of interconnected metal segments that are attached to the frame of the crusher device to define a wearable surface of the container or may an integrally formed structure that is attached to the frame for defining the container of the crusher device in which material is fed and the crusher head 15 is moveably positioned. As another alternative, each segment may be attached to the frame so it abuts immediately adjacent segments and pins or other members may extend between immediately adjacent segments so that certain forces experienced during crushing operations are transferred between the segments as well.

The base 1*a* of the crusher device is below the container portion defined by the inner wall 7 of the crushing device. The frame of the crushing device that defines the frame may include one or more flanges 21, feet, or support arms that engage the ground or foundation on which the crusher device is positioned and support the frame of the crusher device 1. The at least one flange 21 may be a portion of a bottommost external shell of the frame that is composed of metal and is connected to other shells to define the frame of the crusher device. Alternatively, the at least one flange 21 may be attached to an external shell that helps define the frame of the crusher device 1.

It should be understood that the frame of the crusher device may include at least one top shell and one or more middle shells that are attached together to define an external structure of the crusher device. The top and middle shells may define the frame of the top and intermediate sections 1*b* and 1*c* of the frame. The frame may also include one or more bottom shells connected to one or more of the middle shells. The bottom shells may define the frame of the base 1*a*. The shells may be composed of steel or other metal material and be configured to support the forces exerted by the crusher head during crushing operations and support the weight of the crusher device when it is fed material and undergoing crushing operations.

The crusher device may also include other components. For instance, the crusher device may include a lubrication system 25 for providing lubrication to different moveable components. As another example, the crusher device may include a dust seal 27 below or adjacent the discharge opening 12 that surrounds the portion of the crusher head to prevent dust from affecting the gears used to interconnect the countershaft 3 to the eccentric 16 or otherwise affect the operation of the drive system used to drive rotation of the crusher head 15. In one embodiment, the dust seal 27 may be a labyrinth seal. Of course, the crusher device may also include yet other elements to meet a particular design objective.

It should be understood that actuation of movement of the crusher head 15 as well as adjustment of the speed and vertical position of the crusher head 15 may be controlled via a controller that is communicatively coupled to the drive mechanism 2 and the cylinder 17 to actuate movement of the drive mechanism 2 for driving rotation of the countershaft 3 and crusher head 15 and for actuating movement of the piston member 17*a* of the cylinder for controlling a vertical position of the crusher head 15. One or more sensors may be communicatively connected to the controller and attached to different components, such as the drive mechanism 2, countershaft 3, main shaft 5, crusher head 15, eccentric 16, cylinder 17 and other components to measure conditions or detect certain conditions related to crushing operations that may be used to automatically adjust a rate of rotation or height of the crusher head 15.

The controller may be a computer device that is connected to the crusher device or is remote from the crusher device such as a remote workstation or a computer device having one or more microprocessors that execute one or more programs stored on non-transitory memory to which the at least one processor is connected. The controller may be communicatively coupled to the drive mechanism or cylinder via a network connection such as a wired communication network or wireless communication network using wired or wireless interfaces for defining transmission paths for the communication connections between the controller and cylinder 17 and the controller and the drive mechanism 2.

It is contemplated that embodiments of the crusher device can permit the crusher device to provide an output that is between 1.4 and 1.5 times greater than conventional gyratory crushers that have a comparable sized footprint. It is contemplated that the increased crushing capacity and output can be provided by use of the increase in diameter of the crusher head 15 as compared to conventional gyratory crushers having a comparable footprint for embodiments of my crusher device. I believe that the increase in crusher head diameter, or width, is achievable due to a combination of the inclusion of at least one of the eccentric and cylinder being at least partially within a bottom cavity or channel defined at least partially by the body 15*a* of the crusher head 15 as well as the inner wall of the container to extending substantially vertically which increases the volume of the container in which the crusher head 15 is positionable as compared to conventional gyratory crushers having a similar sized footprint and permits the crusher head 15 to be larger in width than comparable conventional designs of a gyratory crusher having a comparable footprint (e.g. height and width). Of course, it is contemplated that the substantially vertically extending inner wall 7, cylinder 17 and eccentric 16 locations, and larger crusher head 15 also provides other advantages such as improved maintenance capabilities. While embodiments of the crusher device 1 may require the similar spatial requirements in terms of height and width for a site of operation, such embodiments can provide a 40-50% increase in crushing capacity as compared to comparable sized conventional gyratory crushers that have a similar spatial requirement.

It should be appreciated that embodiments of the crusher device may be modified in design to meet any of a number of different design objectives. For example, the first, second, and third bushings 29, 29*a* and 42 as well as the spider bushing 9*a* may each be replaced with a bearing such as a radial bearing or a spherical bearing. As another example, the type of gear assembly used to translate motion from a countershaft 3 to the eccentric 16 for rotating the crusher head 15 may utilize a gear box or any of a number of different gear arrangements or intermeshed gear designs. As yet another example, the hydraulic fluid used for controlling the position of the piston member of the cylinder may be located in a container, at least one reservoir, or in one or more accumulators located within the frame of the crusher device 1 or located externally of the frame of the crusher device but positioned such that they are in fluid communication with the cylinder 17 for controlling a position of the piston member 17*a* of the cylinder. As yet another example, the shape and size of the frame of the crusher device, size of the crusher head 15 and height and width of the container defined by an inner wall of the crusher device may be any of a number of possible shapes and sizes to meet a particular design objective such as a desired crushing capacity, a desired cost associated with maintenance of the device, a desired capital cost associated with the making and sale of the device, a desired cost associated with the transport of the device for delivery and installation of the device, or a desired cost associated with the installation of the device.

While certain present preferred embodiments of a crusher device and methods of making and using the same have been shown and described above, it is to be distinctly understood that the invention is not limited thereto but may be otherwise variously embodied and practiced within the scope of the following claims.

I claim:

1. A gyratory crusher comprising:

a container having a space for receiving material to be crushed, the space of the container defined at least partially by an inner wall of the gyratory crusher;

a crusher head positioned within the container;

a top section provided with a spider extending between a first side of the crusher and a second side of the crusher;

the crusher head being located within the container such that rotational or eccentric movement of the crusher head causes material located within the container to be crushed; and, a central hub of the spider being positioned adjacent to the crusher head;

wherein the crusher head has at least one aperture defined therein, and at least one of (i) an eccentric and (ii) a piston of a cylinder is at least partially positioned within the at least one aperture of the crusher head;

wherein the at least one aperture is comprised of a first cavity or first channel defined in a body of the crusher head, the body of the crusher head attached to a mantle such that the mantle directly engages material to crush the material; and wherein the eccentric and the cylinder are each partially positioned within the first cavity or first channel of the body of the crusher head, the piston of the cylinder is comprised of a piston member that is adjustable to a plurality of positions to adjust a vertical position of the crusher head within the container.

2. The gyratory crusher of claim 1 wherein at least a portion of the eccentric surrounds a portion of the cylinder.

3. The gyrator crusher of claim 1 wherein the inner wall extends upwardly such that the inner wall is substantially vertical or perfectly vertical.

4. The gyratory crusher of claim 3 wherein the inner wall has a bottom portion, the bottom portion of the inner wall being curved or bent away from the crusher head to define an outer side of a discharge opening through which crushed material passes, the discharge opening being defined by a bottom portion of the crusher head and the bottom portion of the inner wall.

5. The gyratory crusher of claim 4 wherein the body of the crusher head is attached to a main shaft located adjacent a center of the crusher head and the bottom portion of the crusher head that defines the discharge opening is a bottom portion of the mantle.

6. The gyratory crusher of claim 1 wherein the at least one aperture is comprised of a first channel and the eccentric is positioned at least partially within the first channel and wherein the crusher head rotationally moves by eccentrically rotating.

7. The gyratory crusher of claim 1 wherein the at least one aperture is comprised of a first aperture and wherein the cylinder is a hydraulic cylinder and wherein the piston of the cylinder is positioned within the first aperture adjacent to at least one of a body of the crusher head and a main shaft of the crusher head, the piston of the cylinder at least partially supporting the crusher head for vertically moving the crusher head or substantially vertically moving the crusher head.

8. The gyratory crusher of claim 1 wherein the at least one aperture is at least one cavity formed in a body of the crusher head wherein the crusher head is attached to a main shaft adjacent to a body of the crusher head positioned between the main shaft and a mantle, the mantle attached to the body of the crusher head to engage material within the container to crush the material, the main shaft having an upper end and a bottom end, the upper end of the main shaft being moveably positioned adjacent to a central hub of the spider.

9. The gyratory crusher of claim 1 wherein the at least one aperture is comprised of a first aperture defined in a body of the crusher head, the inner wall is a first wall and wherein the crusher is comprised of at least one second wall extending from within the first aperture to a position below the crusher head that defines an opening sized to receive and retain a portion of the cylinder; and wherein the body of the crusher head is attached to a mantle such that the mantle directly engages with material to crush the material; and wherein the eccentric and the piston of the cylinder are each partially positioned within the first aperture of the body of the crusher head, the piston of the cylinder comprising a piston member that is adjustable to a plurality of positions to adjust a position of the crusher head within the container; and wherein the piston member is extendable and retractable from within the opening defined by the at least one second wall; and wherein the piston member and the crusher head move vertically or generally vertically relative to the eccentric when the piston member is extended or retracted.

10. The gyratory crusher of claim 1 wherein the crusher head is attached to a mantle.

11. The gyratory crusher of claim 10 wherein the mantle includes an upper mantle and a lower mantle that are attached together.

12. A gyratory crusher comprising:

a container having a space for receiving material to be crushed, the space of the container defined at least partially by an inner wall of the gyratory crusher;

a crusher head positioned within the container;

a top section provided with a spider extending between a first side of the crusher and a second side of the crusher;

the crusher head being located within the container such that rotational or eccentric movement of the crusher head causes material located within the container to be crushed; and, a central hub of the spider being positioned adjacent to the crusher head;

wherein the crusher head has at least one aperture defined therein, and at least one of (i) an eccentric and (ii) a piston of a cylinder is at least partially positioned within the at least one aperture of the crusher head;

wherein the at least one aperture is comprised of a first aperture and wherein the cylinder is a hydraulic cylinder and wherein the piston of the cylinder is positioned within the first aperture adjacent to at least one of a body of the crusher head and a main shaft of the crusher head, the piston of the cylinder at least partially supporting the crusher head for vertically moving the crusher head or substantially vertically moving the crusher head.

13. A gyratory crusher comprising:

a container having a space for receiving material to be crushed, the space of the container defined at least partially by an inner wall of the gyratory crusher;

a crusher head positioned within the container;

a top section provided with a spider extending between a first side of the crusher and a second side of the crusher;

the crusher head being located within the container such that rotational or eccentric movement of the crusher head causes material located within the container to be crushed; and, a central hub of the spider being positioned adjacent to the crusher head;

wherein the crusher head has at least one aperture defined therein, and at least one of (i) an eccentric and (ii) a piston of a cylinder is at least partially positioned within the at least one aperture of the crusher head;

wherein the at least one aperture is at least one cavity formed in a body of the crusher head wherein the crusher head is attached to a main shaft adjacent to a body of the crusher head positioned between the main shaft and a mantle, the mantle attached to the body of the crusher head to engage material within the container to crush the material, the main shaft having an upper end and a bottom end, the upper end of the main shaft being moveably positioned adjacent to a central hub of the spider.

* * * * *